US009534338B2

(12) United States Patent
Fagstad et al.

(10) Patent No.: US 9,534,338 B2
(45) Date of Patent: Jan. 3, 2017

(54) WASHING MACHINE

(75) Inventors: Kjell Fagstad, Nürnberg (DE); Nicola Ius, Zoppola (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 1235 days.

(21) Appl. No.: 13/514,134

(22) PCT Filed: Dec. 15, 2010

(86) PCT No.: PCT/EP2010/069719

§ 371 (c)(1),
(2), (4) Date: Aug. 20, 2012

(87) PCT Pub. No.: WO2011/080074

PCT Pub. Date: Jul. 7, 2011

(65) Prior Publication Data

US 2012/0312055 A1 Dec. 13, 2012

(30) Foreign Application Priority Data

Dec. 16, 2009 (EP) ..... 09179531
Nov. 26, 2010 (EP) ..... 10192652

(51) Int. Cl.
*D06F 33/02* (2006.01)
*D06F 39/00* (2006.01)

(52) U.S. Cl.
CPC ..... *D06F 39/005* (2013.01)

(58) Field of Classification Search
CPC ..... D06F 39/005
See application file for complete search history.

(56) References Cited

U.S. PATENT DOCUMENTS 4,235,085 A 11/1980 Torita
4,553,413 A 11/1985 Genji et al.
(Continued)

FOREIGN PATENT DOCUMENTS

DE 35 41 810 6/1987
DE 89 14 729 7/1990
(Continued)

OTHER PUBLICATIONS

Machine Translation of EP 2085508 to Dahkle, Aug. 2009.*
(Continued)

*Primary Examiner* — Michael Barr
*Assistant Examiner* — Benjamin L Osterhout
(74) *Attorney, Agent, or Firm* — Banner & Witcoff, Ltd.

(57) ABSTRACT

The invention is related to a washing machine (1) comprising: a washing tub (5) comprising a rotatable drum (6) adapted for receiving the laundry (7) to be washed; a logic unit (12) adapted to control the electric and/or electronic components of the washing machine (1) so as to make the latter to perform a washing cycle comprising one or more phases; a user interface (13) adapted for setting a washing program to which corresponds a washing cycle to be performed, and for presenting user information; a weighing device adapted to detect the weight of the laundry (7) loaded into the rotatable drum (6). The logic unit (12) is configured for displaying via the user interface (13), during the loading of the laundry (7) into the rotatable drum (6), information related to the duration and/or the number of repetition of one or more phases of the washing cycle corresponding to a set washing program and adapted to the weight of the loaded laundry (7) detected by the weighing device.

30 Claims, 5 Drawing Sheets

(56) References Cited

U.S. PATENT DOCUMENTS

2002/0040505 A1* 4/2002 Tanaka ..... D06F 39/005 8/158
2002/0046581 A1* 4/2002 Shimakage ..... D06F 39/003 68/12.04
2006/0021392 A1* 2/2006 Hosoito ..... D06F 33/02 68/12.04
2008/0201868 A1* 8/2008 Bang ..... D06F 35/006 8/159
2008/0216251 A1* 9/2008 Kahm ..... D06F 35/006 8/159
2008/0216517 A1* 9/2008 Chung ..... D06F 25/00 68/12.04
2008/0236208 A1* 10/2008 Miyata ..... D06F 35/001 68/5 C
2008/0244836 A1* 10/2008 Kim ..... D06F 33/02 8/159
2008/0276382 A1* 11/2008 Benne ..... D06F 39/005 8/158
2009/0064421 A1* 3/2009 Lee ..... D06F 35/00 8/137
2009/0183319 A1* 7/2009 Chai ..... D06F 39/08 8/159
2009/0241267 A1* 10/2009 Kim ..... D06F 39/02 8/149.1

FOREIGN PATENT DOCUMENTS

| | | |
|---|---|---|
| DE | 199 46 245 C2 | 9/2002 |
| EP | 0 051 491 | 5/1982 |
| EP | 1 029 964 | 8/2000 |
| EP | 1 683 902 | 7/2006 |
| EP | 2 085 508 | 8/2009 |
| FR | 2 577 949 | 8/1986 |
| GB | 2 225 030 | 5/1990 |

OTHER PUBLICATIONS

Extended European Search Report issued in corresponding European Application No. 09179531.0 dated May 27, 2010.
International Search Report issued in corresponding International Application No. PCT/EP2010/069719, mailed May 31, 2011.

* cited by examiner

WASHING MACHINE

BACKGROUND OF THE INVENTION

The present invention relates to an improved laundry washing machine.

It is underlined that in the present application the expression "washing machine" may as well indicate a "simple" washing machine (i.e. a washing machine which can only wash and rinse the laundry) and a washing-drying machine (i.e. a washing machine which can also dry the laundry), both of the front-loading type and of the top-loading type.

Nowadays washing machines generally comprise an external casing provided with a loading/unloading door which allows the access to a washing tub containing a rotatable washing drum in which the laundry to be washed can be loaded.

These known washing machines are adapted to perform washing cycles comprising one or more phases, for example a soaking phase, a main wash phase (comprising, for example, the adduction into the washing tub of water mixed with detergent and the rotation of the drum, so as to apply a mechanical action on the laundry), a steam supplying phase, a rinsing phase, a spinning phase, etc.

These known washing machines comprise also a user interface adapted for allowing a user to set a washing programme to which corresponds a washing cycle to be performed; depending on the specific washing programme set by the user, during a same washing cycle the above mentioned phases of the washing cycle (and/or other phases which have not been mentioned) may be not performed, or performed only once, or also performed two or more times (for example the rinsing phase is typically performed two or more times during a same washing cycle).

Some known washing machines are also provided with a weight sensing device adapted to sense the weight of the laundry which is loaded in the washing drum.

For example GB 2225030 discloses a domestic washing machine comprising a tub suspended resiliently relatively to a mounting frame by a suspension spring. A toroidal coil is connected, via a suspension, to the frame of the washing machine; this coil surrounds concentrically the suspension spring. A coil core is rigidly secured to the tub, inside the suspension spring or surrounding it concentrically; therefore, as the loading of the washing (i.e. the laundry to be washed) increases, the coil core can move downwards with the tub, vertically in the magnetic field of the energized coil, in accordance with the characteristic of the suspension spring. As a result of the change in the position of the magnetizable coil core inside the energized toroidal coil, the magnetic flux is altered considerably. This change in the magnetic flux is converted into signals through electronics, and indicates the weight of the washing introduced into the drum at an indicator window via a plurality of light-emitting diodes or directly via a digital display.

After knowing the weight of the laundry loaded into the washing machine, the user may select the washing program and the quantity of detergent which best fits this quantity of laundry.

This known washing machine, however, isn't adapted to automatically modify the duration of the washing cycle according to the weight of the loaded laundry; for example this known washing machine isn't adapted to automatically reduce the number of rinses in a washing cycle if it detects that the quantity of loaded laundry is small (in which case it would be sufficient a reduced washing/rinsing duration).

This fact leads to wastage of energy and time if the quantity of laundry to be washed is small.

Another example of known washing machine provided with a device for detecting the weight of the laundry loaded into the washing drum is shown in EP 0051491 which discloses a washing machine having its drum/drive mechanism and the tub assembly mounted upon transducers which provide an indication of the weight of the mechanism and assembly, and of the weight of articles loaded into the drum for washing. The transducers input to a microprocessor which determines the weight of the clothes and also the weight of water required to wash that weight of clothes under program conditions, some at least of which are selected by the user. The microprocessor may also control a display which indicates the amount of detergent required. In one embodiment of the invention, the control system of the washing machine is adapted to indicate to the user when the weight of articles loaded into the machine exceeds the maximum weight appropriate to a selected program. It is also disclosed that where a small load of articles is to be dealt with, the control system may be adapted to reduce the number of rinse stages.

However this known washing machine modifies at most the number of rinses if the quantity of laundry is small, but it doesn't modify the number of repetition nor the duration of the other phases of the washing cycle (for example the warming of washing water, the soaking phase, the stirring phase, etc.), and therefore there is the risk, for example, that the duration of one or more of such other phases would be too long for the loaded quantity of laundry, and/or that one or more phases would be repeated too many times, which would lead to wastage of energy and of time.

Moreover this known washing machine may modify the number of rinses, and therefore the duration of the overall washing cycle, but it isn't adapted to inform the user of this modified duration.

A known washing machine comprising the feature of calculating the duration of the washing cycle as a function of the sensed weight of the loaded laundry, and of informing a user about this duration is illustrated for example in EP 1029964; this document discloses a washing machine, in particular a domestic washing machine, having a control panel in which are disposed a programme selection device for setting a wash programme which is dependent upon the washing type. The washing machine is provided with a display device for presenting user information. The washing machine comprises a rotatable drum for receiving washing (i.e. the laundry to be washed), and a sensor for detecting the weight of the washing situated in the drum. The washing machine comprises also a microprocessor control which calculates state variables and user information dependent upon the weight detected by the sensor, and which actuates the display device with these variables and information. The washing machine comprises a first memory, which is integrated into the microprocessor control, for storing first memory values in the form of permissible maximum weights which are associated with each wash programme or respectively with the washing type associated with the wash program. This washing machine comprises a second memory for storing second memory values in the form of detergent desired quantities, and also a third memory for storing values in the form of programme running times. The second and third memory values are associated respectively with a wash programme or respectively with the washing type associated with the wash programme and with a washing weight. The washing machine comprises an evaluation circuit, which is integrated into the microprocessor control, for retrieving the first, second, and third memory values dependent upon the weight of the washing detected by the sensor and upon the weight of the washing detected by the sensor and upon the set wash programme and for calculating first, second and third display values from the respective memory values. The washing machine comprises a display device having a first display part and a second display part. In the first display part the filing level of the drum as first display value, the detergent desired quantity as second display value, and the programme running time as a third display value, are presented in succession. In the second display part, the type of respective display value of the microprocessor control is presented. In particular this document discloses a loading procedure wherein, during the loading of the laundry into the drum, the weight of the laundry is detected and is shown in the display; when the door is closed, and therefore the loading procedure is terminated, the display ends showing the weight of the laundry, and starts showing the detergent quantity which is needed for a selected kind of laundry and for the sensed weight of the laundry. By operation of a start button the wash program starts, and the display starts showing the remaining time (i.e. the time required until the end of the washing cycle); the indicated remaining time becomes down-counted in the course of the wash program.

Also this known solution has however a drawback; in fact the user may know the time remaining to the end of the washing cycle only after finishing loading the laundry and closing the door; if the duration of the washing cycle indicated in the display after the closure of the door is different (for example higher) from the duration desired by the user (for example because the user needs removing the laundry from the washing machine by a certain time), in order to modify this duration the user has firstly to open the door, then to modify the amount of laundry loaded into the drum, successively to close again the door, and finally to verify once more the remaining time indicated in the display. The user has to repeat this procedure until reaching the desired value of the remaining time. It is clear that this procedure may be unpleasant, and it also increases the time required to load the washing machine before starting the washing cycle.

DE 199 46 245 C2 discloses a method for controlling a washing program of a washing machine with an outer tub pivotally suspended or supported on springs, in which an inner drum for accommodating laundry is rotatably mounted and can be actuated by a motor; the washing program is controlled with respect to washing parameters such as water consumption, wash duration, number of rinsing cycles and/or the spinning speed profile and/or with respect to user information which can be displayed by display elements of the washing machine. The control is executed subject to a measured laundry weight value determined by a weight sensor on the basis of the weight-related lowering of the outer tub before water is added to the outer tub. The method described in this document comprises the following methodological steps: —the program control system determines a subsequent measured value that depends on the type and the weight of the laundry located in the drum; —computation of the actual weight of the laundry on the basis of the measured laundry weight value and the subsequent measured value by a correction circuit integrated in the program control system; —the program control system proceeds with the wash program using washing parameters dependent upon the actual weight of the laundry. In one embodiment of the method, the subsequent measured value is determined by the program control system on the basis of the suction response after the water has flowed into the outer tub.

U.S. Pat. No. 4,235,085 discloses an automatic vertical axis washer designed to detect a charged quantity of material of washing, and to carry out the respective steps of washing (including rinsing and dehydration) only for a length of time corresponding to the detected quantity. The automatic washer comprises drive means for rotating a stirring blade member or a dehydration tub, and control means connected to the drive means to carry out the respective operation steps of the washer for lengths of time determined by a signal denoting a charged quantity of material which is issued during a washing cycle in accordance with the rotation characteristic of the drive means.

U.S. Pat. No. 4,553,413 discloses a vertical axis washing machine adapted to detect the washing load size in terms of instantaneous variations in such values as the rpm of the agitator and motor current by making use of the fact that the motor load acts discontinuously and instantaneously owing to the movement of the washing load in the washing machine toward and away from the agitator, the size of the resulting detection signal being utilized to control the washing process, making it possible to properly set the washing bath ratio, detergent concentration, washing time, and agitator drive period.

FR 2 577 949 A1 discloses a machine for washing and for spin-drying laundry comprising a means for automatically making the spin-drying duration, in the course of the rinsing phase and/or in the course of the final spin-drying, dependent on at least one of the following parameters: the amount of laundry introduced into the drum, the type of this laundry, and the rotational speed of the drum. In order to determine the load of laundry, i.e. the percentage of the volume of the drum that is occupied by the laundry, a means is provided for measuring the moment of inertia of the laundry relative to the axis of rotation of the drum; for this measurement, the drive torque of the drum at constant acceleration of the drum is determined. Thus, before being filled with water, the drum, filled with dry laundry, is made to rotate at constant known acceleration and the (drum drive) motor torque, which is proportional, to within one constant, to the moment of inertia, is measured. It is disclosed that if a universal motor is used to make the drum rotate and if this motor is powered at constant voltage, it is sufficient to measure the intensity of the current passing through the motor—which is a linear function of the motor torque—in order to obtain a linear representation of the moment of inertia.

SUMMARY OF SELECTED INVENTIVE ASPECTS

A first aim of the present invention is therefore obtaining a washing machine adapted to adapt the duration of the washing cycle to the sensed weight of the loaded laundry, in which the procedure for selecting the quantity of laundry to which corresponds a desired duration or estimated duration of the washing cycle is facilitated, and also the time required for performing this procedure is reduced.

Another aim of the present invention is obtaining an improved washing machine which may automatically adapt the duration of the washing cycle to the weight/quantity of the loaded laundry, and which provides the user with an indication of the duration or of an estimated duration of the washing cycle already before the start of the washing cycle, so as to facilitate the procedure for loading a quantity of laundry suitable to obtain a desired estimated duration of the washing cycle.

It is therefore an object of the present invention to solve the above-noted problems, thereby doing away with the drawbacks of the cited prior art.

The Applicant has found that, according to a first aspect of the invention, by using a washing machine in which information related to the duration and/or the number of repetitions of one or more phases of the washing cycle (and therefore also to the duration of the overall washing cycle), depending on the set washing programme and on the detected weight of the loaded laundry, is displayed during the loading of the laundry, it very easy to load into the washing machine substantially the exact quantity of laundry adapted for obtaining a desired duration of the washing cycle.

The above-mentioned aim and objects, as well as others that will become better apparent hereinafter, may be achieved by a washing machine comprising:

- a washing tub comprising a rotatable drum adapted for receiving the laundry to be washed;
- a logic unit adapted to control the electric and/or electronic components of the washing machine so as to make the latter to perform a washing cycle comprising one or more phases;
- a user interface adapted for setting a washing programme to which corresponds a washing cycle to be performed, and for presenting user information;
- a weighing device adapted to detect the weight of the laundry loaded into the rotatable drum.

The logic unit is operatively connected to the weighing device and to the user interface and is configured for adapting the duration and/or the number of repetitions of one or more phases of the washing cycle corresponding to a set washing programme to the weight of the loaded laundry detected by the weighing device, and for displaying information related to the adapted duration and/or number of repetitions via the user interface.

The logic unit is configured for displaying via the user interface, during the loading of the laundry into the rotatable drum, information related to the duration and/or the number or repetition of one or more phases of the washing cycle corresponding to a set washing programme and adapted to the weight of the loaded laundry detected by the weighing device.

Advantageously the information related to the duration and/or the number of repetitions of one or more phases of the washing cycle corresponding to a set washing programme and adapted to the weight of the loaded laundry detected by the weighing device may comprise the duration of the overall washing cycle.

Opportunely the information related to the duration and/or the number of repetitions of one or more phases of the washing cycle corresponding to a set washing programme and adapted to the weight of the loaded laundry detected by the weighing device may comprise the approximate hour of the day at which the end of the washing cycle is foreseen for the set washing programme and the detected weight of the laundry loaded into the rotatable drum.

In a preferred embodiment, the logic unit may be configured for calculating and for displaying, via the user interface, after the setting of a washing programme and before starting the loading of the laundry into the rotatable drum, the duration of the overall washing cycle which corresponds to the set washing programme and which is suitable for a weight of the laundry lower than a prefixed value.

In a further embodiment, the logic unit may be configured for calculating and for displaying, via the user interface, after the setting of a washing programme and before starting the loading of the laundry into the rotatable drum, the duration of the overall washing cycle which corresponds to the set washing programme and which is suitable for the maximum weight of laundry which may be introduced into the rotatable drum for the set washing programme.

In a further embodiment thereof, the logic unit may be configured in such a way that after the selection of a washing programme and before starting the loading of the laundry into the rotatable drum, the user interface doesn't represent any information related to the duration of the washing cycle which corresponds to the set washing programme.

In another embodiment, the logic unit may be configured in such a way that, after the setting of a washing programme and before starting the loading of the laundry into the rotatable drum, the user interface calculates and displays the duration and/or to the number of repetitions of one or more phases of the washing cycle which correspond to the set washing programme, and which are suitable as long as the weight of the laundry loaded into the rotatable drum remains below a prefixed value, or which are suitable for the maximum weight of laundry which may be introduced into the rotatable drum for the set washing programme.

Preferably, the information related to the number or repetitions of one or more phases of the washing cycle corresponding to a set washing programme and adapted to the weight of the loaded laundry detected by the weighing device may comprise the number of rinses to be performed during the washing cycle.

Opportunely the logic unit may be configured in such a way to calculate and to display, via the user interface, the maximum weight of the laundry which may be loaded for a set washing programme.

Advantageously the logic unit may be configured in such a way to calculate and to display, via the user interface, during the loading of the laundry, the weight of the loaded laundry and/or the loaded percentage of the maximum allowed weight for the set washing programme.

Preferably the user interface may comprise a level indicator adapted to give a visual indication of the loading level of the rotatable drum.

Opportunely the logic unit may be configured in such a way to calculate and to display, via the user interface, during and/or after the loading of the laundry, information related to the amount of detergent required for the set washing programme and for the detected weight of the laundry loaded into the rotatable drum.

Advantageously the logic unit may be configured in such a way that the information related to the amount of detergent required for the selected washing programme and for the detected weight of the laundry loaded into the rotatable drum is displayed in a region of the user interface different from the region of the user interface where the information related to the duration and/or of the number or repetition of one or more phases of the washing cycle adapted to the weight of the loaded laundry detected by the weighing device is displayed.

In a further embodiment the logic unit may be configured in such a way that after ending the loading of the laundry into the rotatable drum, the information related to the weight of the loaded laundry disappears form the user interface, and the information related to the amount of detergent required for the selected washing programme and for the weight of the laundry loaded into the rotatable drum is displayed in the same region of the user interface where the information regarding the weight of the laundry was previously displayed.

Opportunely the logic unit may be configured in such a way to allow a user to modify the duration and/or the number of repetitions of one or more of the phases of the washing cycle even after the loading of the laundry into the rotatable drum, and to calculate and to display, via the user interface, the duration of the overall washing cycle corresponding to this modified duration and/or number of repetitions.

The Applicant has also found that, according to a further aspect of the invention, by using a washing machine in which information related to the estimated duration and/or number of repetitions of one or more phases of the washing cycle (and therefore also to the estimated duration of the overall washing cycle), depending on the set washing programme and on the weight of the loaded laundry detected by a weighing device, is displayed during the loading of the laundry, it very easy to load into the washing machine substantially the quantity of laundry adapted for obtaining a desired estimated duration of the washing cycle.

A further aspect of the invention relates to a washing machine comprising:

- a washing tub comprising a rotatable drum adapted for receiving the laundry to be washed;
- a logic unit adapted to control the electric and/or electronic components of the washing machine so as to make the latter to perform a washing cycle comprising one or more phases;
- a user interface adapted for setting a washing programme to which corresponds a washing cycle to be performed, and for presenting user information;
- a weighing device adapted to detect the weight of the laundry loaded into the rotatable drum.

The logic unit is operatively connected to the weighing device and to the user interface, and is configured for displaying information related to the duration and/or number of repetitions of one or more phases of the washing cycle via the user interface, the logic unit being configured for adapting the duration and/or number of repetitions of one or more phases of the washing cycle corresponding to a set washing programme to the actual weight and/or quantity of the loaded laundry calculated/detected, during one or more of the washing phases, as a function of the pressure and/or water level in the washing tub, and/or of the washing liquid absorbed by the loaded laundry, and/or of one or more electrical and/or mechanical quantities related to the rotation of the drum;

The logic unit is configured for calculating and for displaying via the user interface, during the loading of the laundry into the rotatable drum, information related to the estimated duration and/or number or repetition of one or more phases of the washing cycle corresponding to a set washing programme and adapted to the weight of the loaded laundry detected by the weighing device.

Advantageously the information related to the estimated duration and/or number of repetitions of one or more phases of the washing cycle corresponding to a set washing programme and adapted to the weight of the loaded laundry detected by the weighing device may comprise the estimated duration of the overall washing cycle.

Opportunely the information related to the estimated duration and/or number of repetitions of one or more phases of the washing cycle corresponding to a set washing programme and adapted to the weight of the loaded laundry detected by the weighing device may comprise the approximate hour of the day at which the end of the washing cycle is foreseen for the set washing programme and the weight of the laundry loaded into the rotatable drum detected by said weighing device.

In a preferred embodiment, the logic unit may be configured for calculating and for displaying, via the user interface, after the setting of a washing programme and before starting the loading of the laundry into the rotatable drum, the duration of the overall washing cycle which corresponds to the set washing programme and which is suitable for a weight of the laundry lower than a prefixed value.

In a further embodiment, the logic unit may be configured for calculating and for displaying, via the user interface, after the setting of a washing programme and before starting the loading of the laundry into the rotatable drum, the duration of the overall washing cycle which corresponds to the set washing programme and which is suitable for the maximum weight of laundry which may be introduced into the rotatable drum for the set washing programme.

In a further embodiment thereof, the logic unit may be configured in such a way that after the selection of a washing programme and before starting the loading of the laundry into the rotatable drum, the user interface doesn't represent any information related to the duration of the washing cycle which corresponds to the set washing programme.

In another embodiment, the logic unit may be configured in such a way that, after the setting of a washing programme and before starting the loading of the laundry into the rotatable drum, the logic unit calculates and displays, via the user interface, the duration and/or number of repetitions of one or more phases of the washing cycle which correspond to the set washing programme, and which are suitable as long as the weight of the laundry loaded into the rotatable drum remains below a prefixed value, or which are suitable for the maximum weight of laundry which may be introduced into the rotatable drum for the set washing programme.

Preferably, the information related to the estimated number or repetitions of one or more phases of the washing cycle corresponding to a set washing programme and adapted to the weight of the loaded laundry detected by the weighing device may comprise the estimated number of rinses to be performed during the washing cycle.

Opportunely the logic unit may be configured in such a way to calculate and to display, via the user interface, the maximum weight of the laundry which may be loaded for a set washing programme.

Advantageously the logic unit may be configured in such a way to calculate and to display, via the user interface, during the loading of the laundry, the weight of the loaded laundry detected by the weighing device and/or the loaded percentage of the maximum allowed weight for the set washing programme.

Preferably the user interface may comprise a level indicator adapted to give a visual indication of the loading level of the rotatable drum.

Opportunely the logic unit may be configured in such a way to calculate and to display, via the user interface, during and/or after the loading of the laundry, information related to the amount of detergent required for the set washing programme and for the weight of the laundry loaded into the rotatable drum and detected by the weighing device.

Advantageously the logic unit may be configured in such a way that the information related to the amount of detergent required for the selected washing programme and for the detected weight of the laundry loaded into the rotatable drum is displayed in a region of the user interface different from the region of the user interface where the information related to the estimated duration and/or number or repetition of one or more phases of the washing cycle adapted to the weight of the loaded laundry detected by the weighing device is displayed.

In a further embodiment the logic unit may be configured in such a way that after ending the loading of the laundry into the rotatable drum, the information related to the weight of the loaded laundry disappears form the user interface, and the information related to the amount of detergent required for the selected washing programme and for the weight of the laundry loaded into the rotatable drum is displayed in the same region of the user interface where the information regarding the weight of the laundry was previously displayed.

Opportunely the logic unit may be configured in such a way to allow a user to modify the estimated duration and/or number of repetitions of one or more of the phases of the washing cycle even after the loading of the laundry into the rotatable drum, and to calculate and to display, via the user interface, the estimated duration of the overall washing cycle corresponding to this modified estimated duration and/or number of repetitions.

BRIEF DESCRIPTION OF THE DRAWINGS

Features and advantages of the present invention will be more readily understood from the description that is given below by way of non-limiting example with reference to the accompanying drawings, in which.

DETAILED DESCRIPTION OF EXEMPLARY EMBODIMENTS

The washing machines 1 according to the invention which are schematically illustrated in the appended Figures are advantageously of the front-loading type; it is however clear that the invention is applicable, substantially without any crucial modification, to a top-loading washing machine.

It is also clear that the invention can be applied, substantially without any modification, both to a "simple" washing machine (i.e. a washing machine which can only wash and rinse the laundry) and to a washing-drying machine (i.e. a washing machine which can also dry the laundry).

Figure 3:
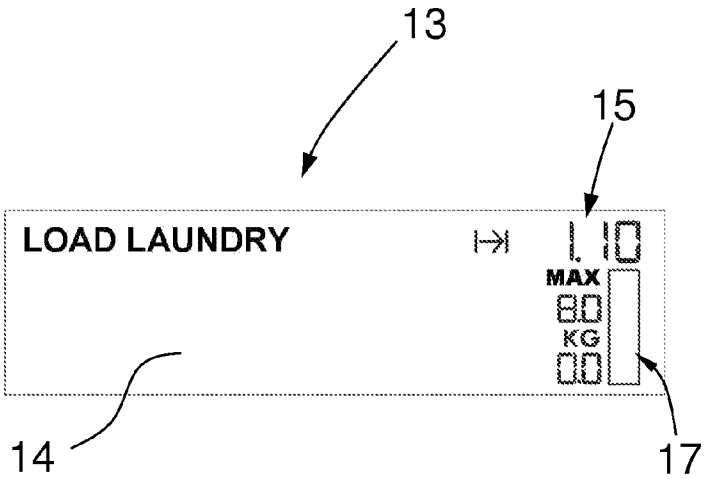
FIG. 3 is an enlarged view of the user interface of the washing machine illustrated in FIG. 2.
Figure 5:
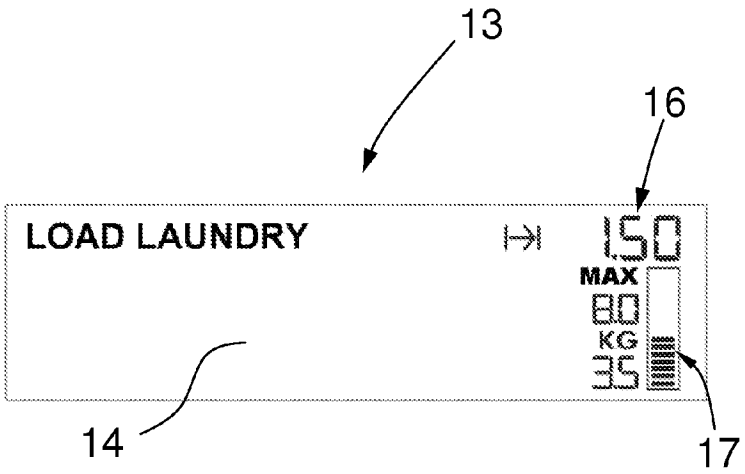
FIG. 5 is an enlarged view of the user interface of the washing machine illustrated in FIG. 4.
Figure 4:
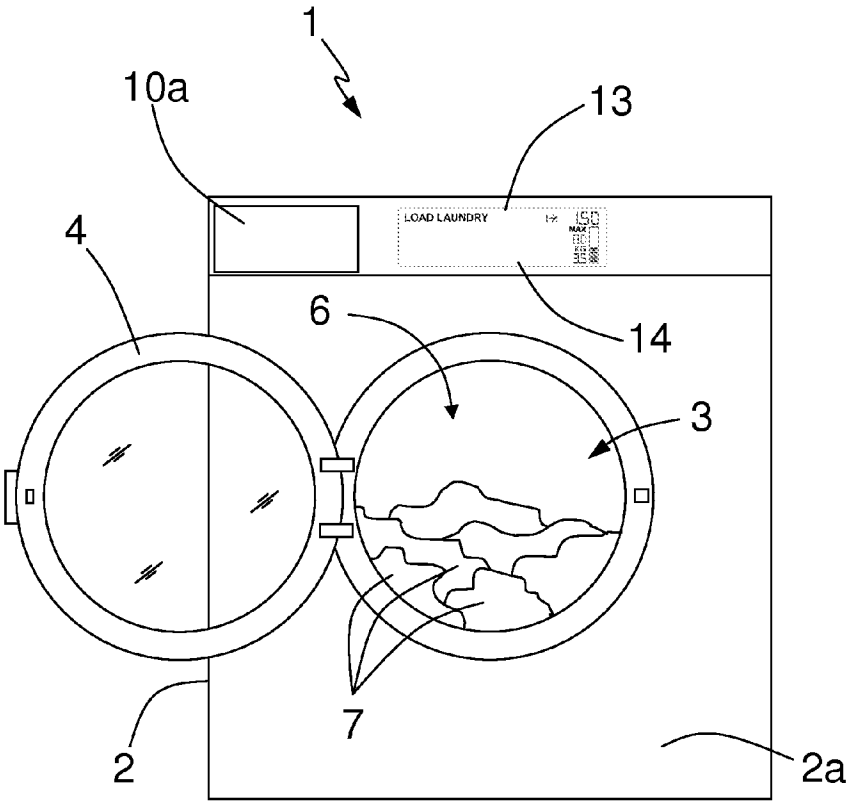
FIG. 4 is a schematic frontal view of the washing machine illustrated in the previous Figures, during the loading of the laundry.
Figure 6:
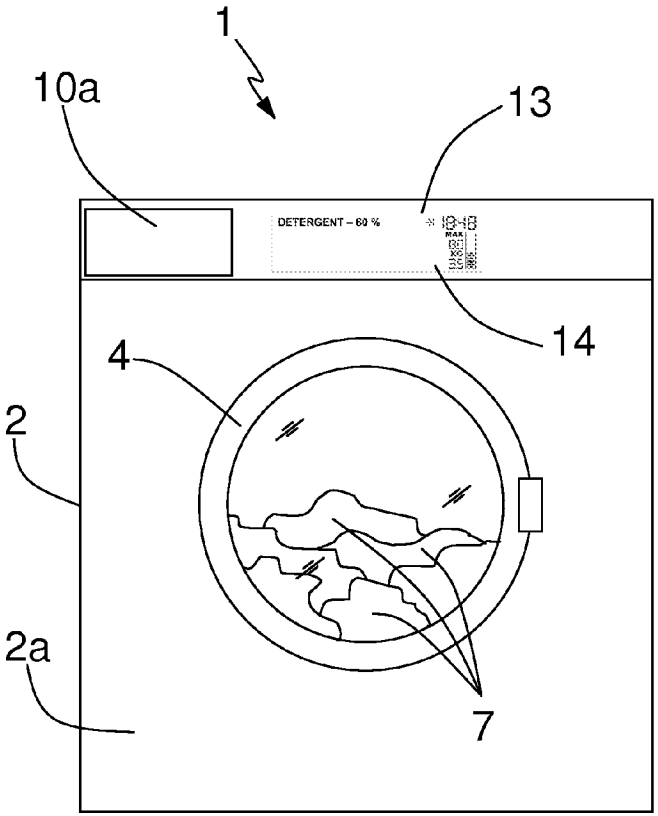
FIG. 6 is a schematic frontal view of the washing machine illustrated in the previous figures after the loading of the laundry.

With reference to FIGS. 1 to 7, the washing machine 1 comprises an external casing 2 in which frontal wall 2*a* (the frontal wall 2*a* has not been represented in FIG. 1) an access opening 3 is obtained, provided with a loading/unloading door 4, which allows the access to a washing tub 5 contained in the external casing 2; the washing tub 5 contains a rotatable perforated drum 6 in which the laundry to be washed, numbered 7 in FIGS. 4 and 6, can be loaded and unloaded.

The washing tub 5 is connected to the external casing 2 preferably via a flexible bellows, not represented, connected between the frontal, opened, surface of the washing tub 5 facing the access opening 3, and the border of the latter.

Figure 1:
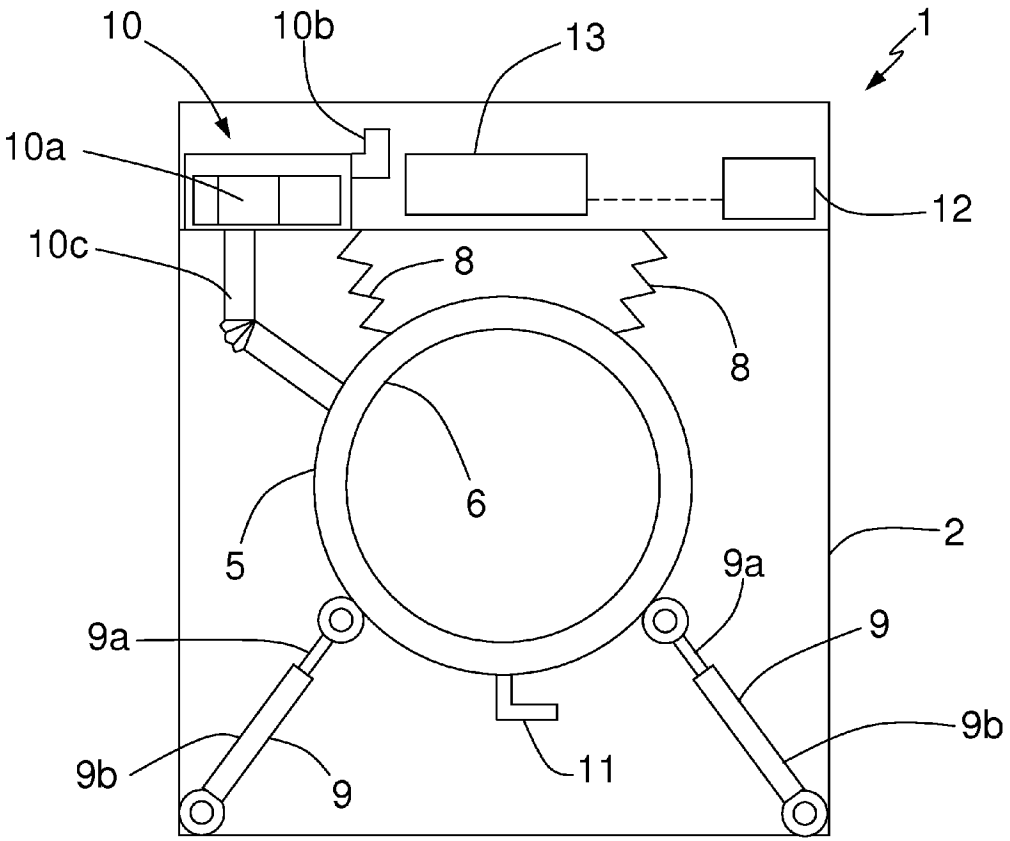
FIG. 1 is a schematic frontal view, with part removed from clarity, of a washing machine according to the invention.

In the example illustrated in FIG. 1, the washing tub 5 is advantageously elastically supported by the external casing 2 via a suitable resilient support system, comprising, for example, two or more springs 8; preferably the oscillations of the washing tub 5 are damped by suitable shock-absorbing devices or dampers 9, interposed between the washing tub 5 and the bottom of the casing 2.

Clearly the washing tub 5 may be associated to the casing 2 in any other suitable way.

Advantageously the washing machine 1 comprises a water inlet circuit 10, only partially illustrated in FIG. 1, adapted for feeding water and washing/rinsing products (i.e. detergents, softeners, etc.) into the washing tub 5; the water inlet circuit comprises, for example, a removable drawer 10*a*, adapted to be filled with washing and/or rinsing products, an inlet duct 10*b* connectable to water delivery mains present outside the washing machine 1 and adapted to deliver fresh water to the drawer 10*a*, and an outlet duct 10*c*, fluidly connecting the drawer 10*a* and the washing tub 5 and adapted to deliver water and washing/rinsing products into the washing tub 5.

The washing machine 1 also comprises a draining circuit 11, only partially represented in FIG. 1, fluidly connected to the bottom of the washing tub 5 and adapted to drain the washing/rinsing liquid from the washing tub 5; in a further embodiment, not illustrated, the draining circuit 11 may be also provided with a recirculation circuit, adapted to drain the washing/rinsing liquid from the bottom of the washing tub 5, and to re-admit such liquid into an upper region of the washing tub 5, for improving the wetting of the laundry.

The washing machine 1 comprises also some electric and/or electronic components, not illustrated, adapted for performing some specific functions; for example the washing machine may comprise an electric motor for rotating the rotatable drum 6, an electric pump adapted to deliver the washing/rinsing liquid into the washing tub 5, an electric pump adapted to drain and/or to re-circulate the washing/rinsing liquid from the washing tub 5, an electric heater adapted to heat the washing/rinsing liquid, etc.

The washing machine 1 advantageously comprises a logic unit (for example an electronic board, a microcontroller, a microprocessor, etc.), schematically indicated in FIG. 1 with the block numbered 12, adapted to control the electric and/or electronic components of the washing machine 1, so as to make the washing machine 1 to perform a washing cycle comprising one or more phases; for example the washing cycle may comprise a prewash phase, a soaking phase, a main wash phase (comprising, for example, the adduction into the washing tub 5 of water mixed with detergent and the rotation of the drum 6, so as to apply a mechanical action on the laundry), a steam supplying phase, a rinsing phase, a spinning phase, etc. According to the set washing programme, as it will be better explained in the following, the washing cycle may comprise one or more of the above mentioned phases (or also other phases well known in the art) adapted to apply to the laundry to be washed a specific chemical and/or physical action. A phase of the washing cycle, depending on the specific washing programme which has been set, may be performed, during a single washing cycle, only once or also two or more times. Clearly the duration of the overall washing cycle depends on the kind, on the number, and on the duration of its phases.

Advantageously, the washing machine 1 comprises a user interface 13, operatively connected to the logic unit 12, adapted for setting a washing programme to which corresponds a washing cycle to be performed, and adapted also for presenting user information; these information may be, for example, the name of a particular washing programme, the weight of the loaded laundry, the duration of the washing cycle, the temperature of the washing/rinsing liquid, the rotating speed of the spinning, etc.; more in general the user interface 13 is adapted to present information related to the washing programme and/or the washing cycle and/or the status of the washing machine 1.

In the embodiments illustrated in the enclosed figures, the user interface 13 advantageously comprises a display device 14, preferably a LCD or a LED display, adapted for presenting user information, and a separated input device, not illustrated, comprising for example a keyboard, and/or a set of keys or knobs, and/or one or more touch-sensitive input devices, etc., adapted for setting a washing programme.

In another embodiment, not illustrated, the user interface 13 may comprise a touch-sensitive display adapted both for presenting user information, and for allowing a user, by touching some specific regions of this touch-screen display, to set a washing programme.

In another embodiment, not illustrated, the logic unit 12 may be advantageously integrated in the user interface 13.

It is underlined that in the present application the expression "to set a washing programme" refers to selecting, among some possibilities provided by the washing machine 1, one or more parameters related to the washing cycle to be performed; for example the user may select the type of laundry to be washed (for example silk, wool, cotton, linen, etc.), and/or the soil degree of the laundry (for example very soiled, soiled, not very soiled, etc.), and/or the possibility to apply or not a steam jet to the laundry (for example to disinfect the latter), and/or the maximal rotation speed of the rotatable drum 6 during the spinning phase, etc. After the user has set these one or more parameters (which corresponds, therefore, to set a washing programme), the logic unit 12 computes these parameters and selects, among a set of washing cycles memorized in its memory, a washing cycle which fits to the parameters set by the user.

For example the logic unit 12 may be configured to set the duration and/or the number of repetitions of one or more of the phases of the washing cycle which, according to the data memorized in the memory of the logic unit 12, best fits to the parameters selected by the user (i.e. to the set washing programme). In this case the logic unit 12 may be configured so as to display, via the user interface 13, the duration of one or more of the phases of the washing cycle, and/or the number of repetition of one or more phases (for example the number of rinses), and/or of the overall duration of the washing cycle, corresponding to the parameters selected by the user.

Figure 2:
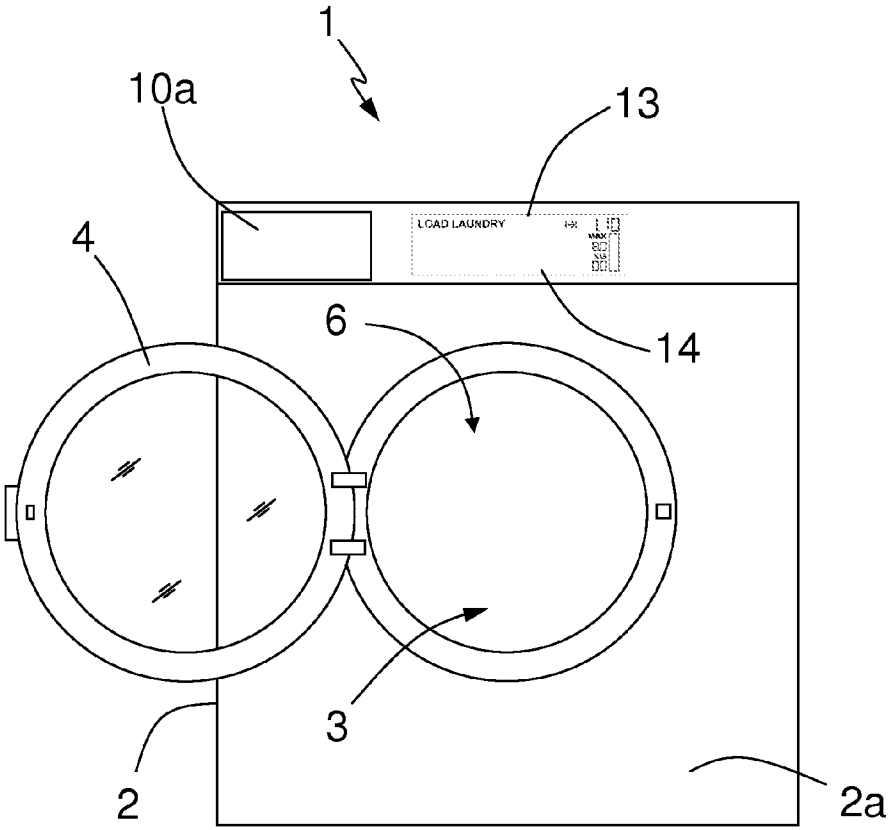
FIG. 2 is a schematic frontal view of the washing machine of FIG. 1 before starting the loading of the laundry.

For example, in FIG. 2 is represented a washing machine 1 according to the invention after the setting of a washing programme but before starting the loading of the laundry into the rotatable drum 6; in FIGS. 2 and 3 is represented a condition in which a user has already set a washing programme by the user interface 13. For example the user may have selected the type of laundry to be washed, the degree of soil, etc.

In the condition represented in FIGS. 2 and 3, after the user has set a washing programme, the logic unit 12 has selected, among the washing cycles memorized in its memory, the washing cycle which best fits to the washing programme set by the user, and it has also calculated and displayed in the display device 14 a minimum value (indicated in FIG. 3 by the reference number 15) of the duration of the overall washing cycle which corresponds to the set washing programme and which is suitable for a weight of the laundry 7 loaded into the rotatable drum 6 lower than a prefixed value (for example 1 kg, or 2 kg, etc.) which is stored in the memory of the logic unit 12; in the example illustrated in FIG. 3, this minimum value of the overall duration of the washing cycle is 1.10 (that is one hour and ten minutes). In this specific example, therefore, up to reaching this prefixed value of the weight of the laundry loaded into the rotatable drum 6, the duration of the overall washing cycle depends only on the selected washing programme, and not on the weight of the laundry.

In a further embodiment, not illustrated, the logic unit 12 may be configured so as to represent via the user interface 13, after the setting of the washing programme but before starting the loading of the laundry 7 into the washing drum 6, a maximum value of the overall duration of the washing cycle which corresponds to the set washing programme and which is suitable for the maximum weight of laundry which may be introduced into the rotatable drum 6 for such a set washing programme.

In a further embodiment, not illustrated, the logic unit 12 may be configured in such a way that after the selection of the washing programme and before starting the loading of the laundry into the rotatable drum 6, the user interface 13 doesn't represent any information related to the duration of the washing cycle.

In a further embodiment thereof, the logic unit 12 may be configured in such a way that, after the selection of the washing programme and before starting the loading of the laundry into the rotatable drum 6, the user interface 13 displays, as a replacement for, or in addition to, the overall duration of the washing cycle, the duration and/or the number of repetition of one or more specific phases of the washing cycle (for example the prewash, and/or the main wash, and/or the rinsing, and/or the spinning, etc.) which correspond to the set washing programme, and which are suitable for a weight of the laundry 7 loaded into the rotatable drum 6 lower than a prefixed value (which may be for example stored in the memory of the logic unit 12), or which are suitable for the maximum weight of laundry which may be introduced into the rotatable drum 6 for such a set washing programme.

Figure 10:
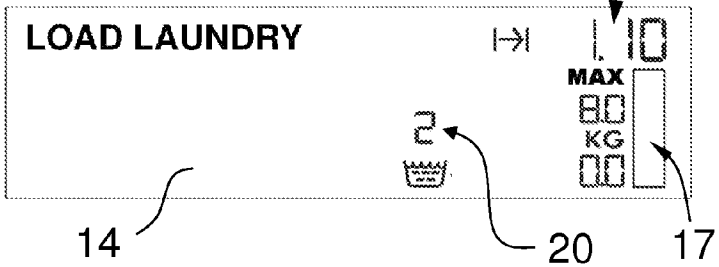
FIG. 10 is an enlarged view of the user interface of the washing machine illustrated in FIG. 9.
Figure 11:
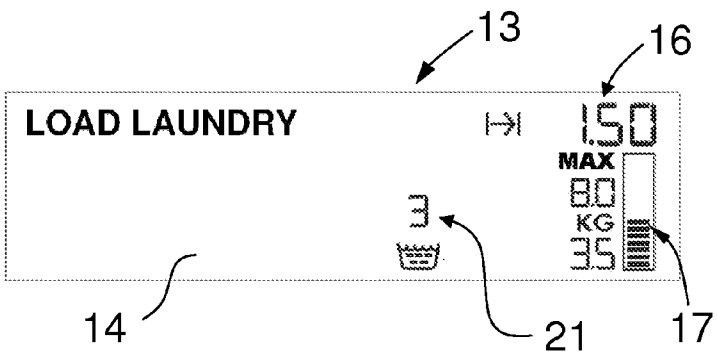
FIG. 11 illustrates the user interface of FIG. 10 during the loading of the laundry.
Figure 9:
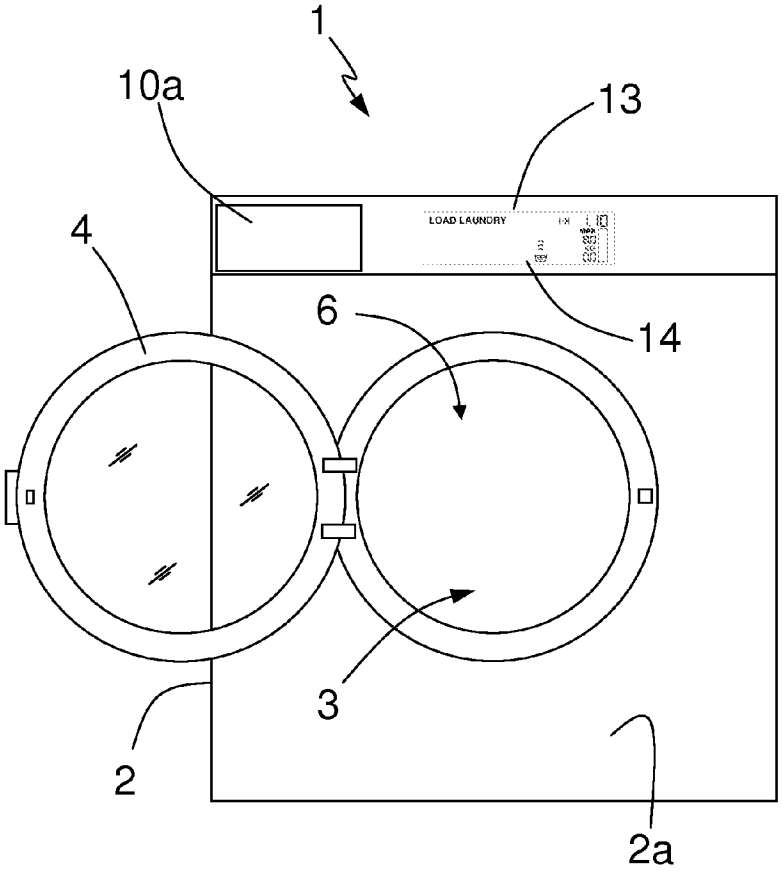
FIG. 9 is a schematic frontal view of another embodiment of a washing machine according to the invention, before starting the loading of the laundry.

For example, in the embodiment illustrated in FIGS. 9, 10 and 11, the logic unit 12 is advantageously configured in such a way that, after the selection of the washing programme and before starting the loading of the laundry into the rotatable drum 6, the user interface 13 displays the overall duration (numbered 15 in FIG. 10) of the washing cycle and the number of rinses (numbered 20 in FIG. 10) which correspond to the set washing programme, and which are suitable for a weight of the laundry 7 loaded into the rotatable drum 6 lower than a prefixed value (which is stored in the memory of the logic unit 12).

Advantageously, but not necessarily, the logic unit 12 may be configured in such a way to represent via the user interface 13 also the maximum weight of the laundry which may be loaded for a set washing programme; for example in the display device 14 of FIG. 3, and in the display device 14 of FIG. 10 there are represented the maximum weight of laundry which may be introduced into the rotatable drum 6 (i.e. 8.0 kilograms) for a selected washing programme, and the duration of the overall washing cycle (in this case 1 hour and 10 minutes) corresponding to the selected washing programme and suitable for a weight of the laundry 7 loaded into the rotatable drum 6 lower than a prefixed value, not illustrated.

The washing machine 1 is also provided with a weighing device, not illustrated, adapted to detect the weight of the laundry 7 during its loading into the rotatable drum 6 (and therefore before the start of the washing cycle).

For example, the weighing device may comprise one or more transducers, not illustrated, operatively connected to the logic unit 12; the transducers may comprise, for example, a load cell or a strain gauge.

Advantageously one or more transducers may be associated with the resilient support system 8 supporting the washing tub 5; in a further embodiment one or more transducers may be associated with the support of the washing machine 1 (for example to one or more support feet, not represented, adapted to support the casing 2 of the washing machine 1), so as to detect the overall weight of the washing machine 1 (in this last case the weight sensed by the one or more transducers increases when the laundry is loaded into the rotatable drum 6).

In a further embodiment thereof, the weighing device may comprise one or more transducers, not illustrated, adapted to sense a variation of the length of the shock-absorbing devices or dampers 9, and to communicate this information to the logic unit 12, which is configured in such a way to associate this length variation to a variation of the weight of the washing tub 5, and therefore to the weight of the laundry 7 loaded into the rotatable drum 6.

For example, one or more of the dampers 9 interposed between the washing tub 5 and the bottom of the casing 2 may comprise a piston 9*a* movable in a cylindrical housing 9*b*, and a device, not illustrated, adapted to measure the position of the piston 9*a* inside the housing 9*b*; this device may comprise a coil unit wound around the housing 9*b* of the damper 9 and a sensor element located at the end of the piston 9*a*, which is located inside the cylindrical housing 9*b*. The sensor element may be made of metal, e.g. iron. The coil unit is connected by wire to an evaluating unit of the washing machine 1, operatively connected to the logic unit 12 (the evaluating unit may be for example comprised in the logic unit 12). When the piston 9*a*, and therefore the sensor element, moves, e.g. due to loading the washing machine 1 with laundry 7, the sensor element changes the inductivity of the coil unit. As the change of inductivity is proportional to the penetration depth of the piston 9*a* into the coil unit, the travel path length of the piston 9*a* can be determined by the evaluating unit. The logic unit 12 may be in this case configured for calculating the weight of the laundry loaded into the rotatable drum 6 as a function of the detected travel path length of the piston 9*a*.

However it is underlined that the use of a particular weighing device is not critical for the invention, and therefore substantially any device adapted to detect the weight of the laundry 7 during its loading into the rotatable drum 6 may be used.

In a first advantageous embodiment of the invention the logic unit 12 is advantageously configured for adapting the duration and/or the number of repetitions of one or more phases of the washing cycle corresponding to a set washing programme to the weight of the loaded laundry 7 detected by the weighing device, and for displaying, via the user interface 13, during the loading of the laundry 7 into the rotatable drum 6, information related to the duration and/or to the number of repetitions of one or more of the phases (e.g. the number of rinses) of the washing cycle modified according to the weight of the loaded laundry 7 detected by the weighing device.

In a second advantageous embodiment of the invention, the logic unit 12 is configured for calculating the estimated duration and/or number of repetitions of one or more phases of the washing cycle corresponding to a set washing programme and to the weight of the loaded laundry 7 detected by the weighing device, and for displaying, via the user interface 13, during the loading of the laundry 7 into the rotatable drum 6, information related to the estimated duration and/or number of repetitions of one or more of the phases (e.g. the number of rinses) of the washing cycle modified according to the weight of the loaded laundry 7. In this second advantageous embodiment, the logic unit 12 is also configured for adapting the duration and/or number of repetitions of one or more phases of the washing cycle corresponding to a set washing programme to the actual weight and/or quantity of the loaded laundry 7 calculated/detected, during one or more of the washing phases, as a function of the pressure and/or water level in the washing tub 5 (detected for example by a pressostat), and/or of the washing liquid absorbed by the loaded laundry 7, and/or of one or more electrical and/or mechanical quantities related to the rotation of the drum 6 and/or to the electric motor rotating the drum (for example the behaviour of the electrical current absorbed by the electric motor rotating the drum, the drive torque of the motor, the inertia of the loaded drum, etc.). In other words, in this second advantageous embodiment, the logic unit 12 is advantageously configured for calculating and setting, during one or more of the washing phases, an actual duration and/or number of repetitions of one or more phases of the washing cycle as a function of the actual weight and/or quantity of the loaded laundry 7; this actual weight/quantity is calculated/detected as a function of the pressure and/or water level in the in the washing tub 5, and/or of the washing liquid absorbed by the loaded laundry 7, and/or of one or more electrical and/or mechanical quantities related to the rotation of the drum 6 and/or to the electric motor rotating the drum. The above mentioned ways of calculating/detecting the actual weight and/or quantity of the loaded laundry 7, during one or more of the washing phases, as a function of the pressure and/or water level in the in the washing tub 5, and/or of the washing liquid absorbed by the loaded laundry 7, and/or of one or more electrical and/or mechanical quantities related to the rotation of the drum 6 and/or to the electric motor rotating the drum, are known in the art, and therefore they will not be described more precisely.

It is underlined that in the following, the expressions "duration" and "number of repetitions" will refer to the above mentioned first embodiment of the invention, in which the logic unit 12 is advantageously configured for adapting the duration and/or the number of repetitions of one or more phases of the washing cycle corresponding to a set washing programme to the weight of the loaded laundry 7 detected by the weighing device; the expressions "estimated duration", "estimated number of repetitions" and "actual duration" will instead refer to the above mentioned second embodiment of the invention.

It is clear that adapting the duration (or, with reference to the second embodiment, the estimated duration) and/or the number of repetitions (or, with reference to the second embodiment, the estimated number of repetitions) of one or more phases of the washing cycle affects the duration (or the estimated duration) of the overall washing cycle, and therefore the expression "information related to the duration (or to the estimated duration) and/or to the number (or to the estimated number) of repetitions of one or more of the phases of the washing cycle" may as well indicate information related to the duration (or to the estimated duration) and/or to the number (or to the estimated number) of repetitions of one or more specific phases of the washing cycle (for example the rinsing phase) and also information related to the duration (or to the estimated duration) of the overall washing cycle (which depends on, and therefore is related to, the duration—or the estimated duration—and the number—or the estimated number—of repetitions of its phases).

It is underlined that, with reference to the above mentioned second embodiment, the estimated duration and/or number of repetitions of one or more specific phases of the washing cycle doesn't necessarily coincide with the actual duration and/or number of repetitions of one or more specific phases of the washing cycle calculated by the logic unit 12 as a function of the actual weight and/or quantity of the loaded laundry 7 calculated/detected, during one or more of the washing phases, as a function of the pressure and/or water level in the washing tub 5, and/or of the washing liquid absorbed by the loaded laundry 7, and/or of one or more electrical and/or mechanical quantities related to the rotation of the drum 6 and/or to the electric motor rotating the drum; in fact the measure of the weight of the laundry 7 obtained by the weighing device may be less precise than the measure of the actual weight and/or quantity of the loaded laundry 7 actuated during one or more of the washing phases (preferably at the very beginning of the washing cycle), as a function of the pressure and/or water level in the washing tub 5, and/or of the washing liquid absorbed by the loaded laundry 7, and/or of one or more electrical and/or mechanical quantities related to the rotation of the drum 6 and/or to the electric motor rotating the drum.

In the above mentioned second embodiment, in which the logic unit 12 is configured for adapting the duration and/or number of repetitions of one or more phases of the washing cycle corresponding to a set washing programme to the actual weight and/or quantity of the loaded laundry 7 calculated/detected, during one or more of the washing phases, as a function of the pressure and/or water level in the washing tub 5, and/or of the washing liquid absorbed by the loaded laundry 7, and/or of one or more electrical and/or mechanical quantities related to the rotation of the drum 6 and/or to the electric motor rotating the drum, the estimated duration and/or number of repetitions of one or more specific phases of the washing cycle corresponding to a selected washing programme and to the weight of the laundry 7 present into the rotatable drum 6 and detected by the weighing device is therefore used mainly for providing the user with a quick but rough indication of which approximately will be the duration and/or number of repetitions of one or more specific phases of the washing cycle, so that he can quickly foresee how long the washing procedure corresponding to the selected washing programme will approximately last for a loaded weight/quantity of loaded laundry; by this quick indication the user may therefore decide to unload some laundry or to load some more laundry, in order to obtain the desired estimated duration of the washing cycle. In this second embodiment, the actual duration and/or number of repetitions of one or more specific phases of the washing cycle is calculated by the logic unit 12 only after the beginning of the washing cycle (preferably at the very beginning of the washing cycle), as indicated above, and it may be more precise than the estimated duration and/or number of repetitions of one or more specific phases of the washing cycle calculated by the weighing device.

In the example illustrated in the enclosed FIGS. 1 to 7, the logic unit 12 is advantageously configured so that, during the loading of the laundry 7 into the rotatable drum 6, the logic unit 12 may calculate and display, via the user interface 13, the duration (or, in the above mentioned second embodiment, the estimated duration) of the overall washing cycle corresponding to a selected washing programme and to the weight of the laundry 7 present into the rotatable drum 6.

For example, in FIGS. 4 and 5 it is represented the user interface 13 of a washing machine 1 according to the invention after the selection of a washing programme and during the loading of the laundry 7 into the rotatable drum 6; in this case the display device 14 of the user interface 13 advantageously represents the duration (or the estimated duration) of the overall washing cycle, indicated FIG. 5 by the reference number 16, which has been modified by the logic unit 12 for adapting it to the weight of the laundry 7 loaded into the rotatable drum 6 which has been detected by the weighing device.

In the display device 14 of FIG. 5 the duration (or the estimated duration) of the overall washing cycle is indicated as "1.50" (that is 1 hour and 50 minutes); it is noticed that the duration (or the estimated duration) of the overall washing cycle has been increased with respect to the duration (or the estimated duration) indicated in FIG. 3 (which was 1.10), because a certain amount of laundry 7 has been loaded into the rotatable drum 6, and the logic unit 12 has adapted the duration (or the estimated duration) of the overall washing cycle to the weight of this laundry sensed by the weighing device.

In a further embodiment, not illustrated, the logic unit 12 may be adapted to represent via the user interface 13, after the setting of the washing programme but before staring the loading of the laundry 7 into the washing drum 6, a maximum value of the duration of the overall washing cycle which corresponds to the set washing programme and which is suitable for a prefixed maximum weight of laundry which may be introduced into the rotatable drum 6 for such a set washing programme. In this case, if the weight of the laundry 7 introduced in the rotatable drum 6 is lower than this prefixed maximum weight, the duration and/or the number of repetitions of one or more phases of the washing cycle (and therefore the duration of the overall washing cycle) suitable for the set washing programme and for this loaded laundry 7 is lower than the duration and/or the number of repetitions suitable for the maximum weight; therefore, in this case, if the weight of the laundry loaded into the rotatable drum 6 is lower than the maximum weight, the duration (or the estimated duration) of the overall washing cycle displayed in the user interface 13 decreases with respect to the above indicated maximum value.

In a further embodiment thereof, also not illustrated, the logic unit 12 may be configured in such a way that, after the selection of a washing programme and before starting the loading of the laundry into the rotatable drum, the user interface doesn't represent any information related to the duration (or estimated duration) of the washing cycle which corresponds to the set washing programme; in this case the logic unit 12 may be configured in such a way that when the user starts loading the laundry 7 into the rotatable drum 6, the logic unit 12 calculates the duration (or the estimated duration) and/or the number (or the estimated number) of repetitions of one or more phases of the washing cycle (and therefore the duration—or the estimated duration—of the overall washing cycle) suitable for the weight of the loaded laundry 7 detected by the weighing device and for the set washing programme, and displays via the user interface 13 information related to this calculated duration (or estimated duration) and/or number (or estimated number) of repetitions of one or more phases of the washing cycle (for example the duration—or the estimated duration—of the overall washing cycle).

In a further embodiment, not illustrated, the logic unit 12 may be configured for calculating and displaying, via the user interface 13, after a washing programme has been set and during the loading of the laundry 7 into the rotatable drum 6, the approximate hour of the day at which the end of the washing cycle is foreseen (starting substantially in that moment, or according to a preferred delay which may be set by the user) for the set washing programme and for the weight of the laundry present in that moment into the rotatable drum 6 detected by the weighing device.

In the embodiment illustrated in FIGS. 9 to 11, the logic unit 12 is advantageously configured for displaying, via the user interface 13, during the loading of the laundry 7 into the rotatable drum 6, both the duration (or the estimated duration) of the overall washing cycle (numbered 16 in FIG. 11) corresponding to a selected washing programme and to the weight of the laundry 7 present into the rotatable drum 6 and detected by the weighing device, and also the number (or estimated number) of rinses (numbered 21 in FIG. 11), corresponding to a selected washing programme and to the weight of the laundry 7 present into the rotatable drum 6 and detected by the weighing device.

In all the above illustrated embodiments, it has been described that the washing programme is set before starting the loading of the laundry into the rotatable drum 6; preferably, but not necessarily, the logic unit 12 may be configured in such a way that the washing programme may be set also during the loading of the laundry into the rotatable drum 6 (i.e. after starting loading the laundry). In this case, the logic unit 12 may be configured in such a way that if a certain amount of laundry 7 is loaded into the rotatable drum 6 before setting the washing programme, and then a washing programme is set by the user, the logic unit 12, after the setting of the washing programme, calculates the duration (or the estimated duration) and/or the number (or the estimated number) of repetitions of one or more phases of the washing cycle corresponding to this set washing programme and adapted to the weight of the loaded laundry 7 detected by the weighing device; in this case the logic unit 12 is also configured for displaying, during the loading of the laundry 7, information related to this adapted duration (or estimated duration) and/or number (or estimated number) of repetitions via the user interface 13.

Advantageously, but not necessarily, the user interface 13 and/or the logic unit 12 is adapted to calculate and to display via the user interface 13, during the loading of the laundry 7, the value of the detected weight of the loaded laundry 7 and/or the percentage of the maximum allowed weight for the set programme which is loaded in a particular moment.

For example, in the embodiments illustrated in the enclosed figures the display device 14 of the user interface 13 is advantageously adapted to represent a number indicating the maximum weight allowed for a set washing programme (for example the number "8.0" in FIG. 5), and a number indicating the weight of the laundry 7 loaded into the rotatable drum 6 (for example the number "3.5" in FIG. 5) which has been detected by the weighing device.

Preferably, but not necessarily, the user interface 13 comprises a level indicator 17 adapted to give a visual indication of the loading level of the rotatable drum 6; in the embodiments illustrated in FIGS. 1 to 7 and 9 to 11, the level indicator 17 comprises, for example, a status bar provided in the display device 14, which changes its length (or colour, or shape) according to the weight of the laundry 7 loaded into the rotatable drum 6; clearly this feature may also be absent.

By using a washing machine 1 according to the invention, a user, after setting a washing programme by the user interface 13, may start loading the laundry 7 into the rotatable drum 6; as described above, during the loading of the laundry 7 the weighing device detects the weight of the laundry 7, and the logic unit 12 calculates the duration (or the estimated duration) and/or the number (or the estimated number) of repetitions of one or more of the phases of the washing cycle (and therefore calculates the overall duration—or estimated duration—of the washing cycle) according to a set washing programme and to the weight of the loaded laundry 7 detected by the weighing device; the logic unit 12 also displays via the user interface 13 information related to the duration (or estimated duration) and/or to the number of repetitions (or estimated number of repetitions) of one or more of the phases of the washing cycle depending on the set washing programme and adapted to the weight of the loaded laundry 7 detected by the weighing device.

In the examples illustrated in FIGS. 1 to 7 the logic unit 12 is configured in such a way to calculate and to display via the display device 14, after the setting of the washing programme and during the loading of the laundry 7, the duration of the overall washing cycle corresponding to the set washing programme and to the detected weight of the loaded laundry 7.

In the examples illustrated in FIGS. 9 to 11, after the setting of the washing programme and during the loading of the laundry 7, the display device 14 displays the duration (or the estimated duration) of the overall washing cycle (numbered 16 in FIG. 11) and also the number of repetitions (or estimated number of repetition) of the rinsing phases (numbered 21 in FIG. 11) corresponding to the set washing programme and adapted to the weight of the laundry 7 loaded into the rotatable drum 6 and detected by the weighing device.

Preferably, but not necessarily, the user interface 13 may be arranged in such a way to display information related to the status of the washing machine 1; for example the user interface 13 may indicate (for example by a writing and/or by one or more icons) that the washing machine 1 is switched on but the washing programme has not been yet selected, that the laundry is being loaded, etc. For example the display device 14 illustrated in the enclosed Figures is advantageously arranged in such a way that, during the loading of the laundry 7, it displays the writing "LOAD LAUNDRY"; clearly this feature may also be absent.

When the user reaches the desired value of the duration (or estimated duration) of the overall washing cycle (or the desired value of the duration—or estimated duration- and/or number—or estimated number—of repetitions of one or more washing phases, if this value is represented in the user interface 13), he may conclude the loading of the laundry 7.

The loading of the laundry 7 into the rotatable drum 6 is considered concluded when the user has ceased to introduce the laundry into the rotatable drum 6; it is clear that, after starting loading the laundry into the rotatable drum 6, the loading of the laundry 7 is considered concluded at least after the closure of the door 4.

Advantageously the logic unit 12 may be configured in such a way that, after opening the door 4 and starting the loading of the laundry 7 into the rotatable drum 6, the logic unit 12 considers concluded the loading of the laundry 7 when door 4 is closed. In this case the closure of the door 4 may be detected, for example, by a suitable electric sensor or switch, not illustrated, operatively connected to the logic unit 12 so as to communicate to the latter that the door 4 is closed; in other words, in this case the washing machine 1 is arranged in such a way that, when the door 4 is closed, the logic unit 12 is informed that the loading of the laundry 7 has been concluded (in other words, the conclusion of the loading of the laundry coincides with the closure of the door 4).

In a further embodiment, not illustrated, the washing machine 1 comprises input means adapted for allowing the user to inform the logic unit 12 that the loading of the laundry 7 has been concluded; advantageously the input means may be comprised in the user interface 13, or it my be a dedicated input element, comprising, for example, a button and/or a knob, and/or a touch-sensitive sensor, etc. In this case, when the user has concluded the loading of the laundry 7, he may act on this input means for informing the logic unit 12 that the loading of the laundry has been concluded; in this case the conclusion of the loading of the laundry 7 may not coincide with the closure of the door 4 (for example it may occur some time before the closure of the door 4).

After the loading of the laundry 7 into the rotatable drum 6 is concluded, the user may start a washing cycle, for example by pressing a start button, not illustrated, present in the user interface 13.

In the above mentioned second embodiment (in which the logic unit 12 is configured for adapting the duration and/or number of repetitions of one or more phases of the washing cycle corresponding to a set washing programme to the actual weight and/or quantity of the loaded laundry 7 calculated/detected, during one or more of the washing phases, as a function of the pressure and/or water level in the washing tub 5, and/or of the washing liquid absorbed by the loaded laundry 7, and/or of one or more electrical and/or mechanical quantities related to the rotation of the drum 6 and/or to the electric motor rotating the drum, after the start of the washing cycle), preferably at the very beginning of the washing cycle the logic unit 12 calculates/detects the actual weight and/or quantity of the loaded laundry 7 as a function of the pressure and/or water level in the washing tub 5, and/or of the washing liquid absorbed by the loaded laundry 7, and/or of one or more electrical and/or mechanical quantities related to the rotation of the drum 6 and/or to the electric motor rotating the drum, and modifies the duration and/or number of repetitions of one or more phases of the washing cycle corresponding to the set washing programme as a function of this calculated/detected actual weight and/or quantity of the loaded laundry 7.

Advantageously, but not necessarily, the logic unit 12 may be configured for calculating and for displaying, via the user interface 13, information related to the amount of detergent required for the set washing programme and for the weight of the laundry 7 loaded into the rotatable drum 6 and detected by the weighing device; in the embodiments illustrated in the enclosed Figures, the logic unit 12 is advantageously configured in such a way to calculate and to display, via the user interface 13, information 18 related to the amount of detergent required for the set washing programme and for the weight of the laundry 7 loaded into the rotatable drum 6 and detected by the weighing device, only after ending the loading of the laundry 7. In another embodiment, not illustrated, the logic unit 12 may be configured in such a way to calculate and to display, via the user interface 13, information 18 related to the amount of detergent required for the set washing programme and for the detected weight of the laundry 7 loaded into the rotatable drum 6, also during the loading of the laundry 7.

More in general the logic unit 12 may be configured in such a way to calculate and to display, via the user interface 13, information 18 related to the amount of detergent required for the set washing programme and for the weight of the laundry 7 loaded into the rotatable drum 6 and detected by the weighing device, during and/or after the loading of the laundry 7.

The information 18 related to the amount of detergent required for the selected washing programme and for the weight of the laundry 7 loaded into the rotatable drum 6 and detected by the weighing device may be, for example, the percentage of detergent (related to the maximum quantity of detergent allowed), required for a selected washing programme and for the quantity of laundry 7 detected by the weighing device.

Figure 7:
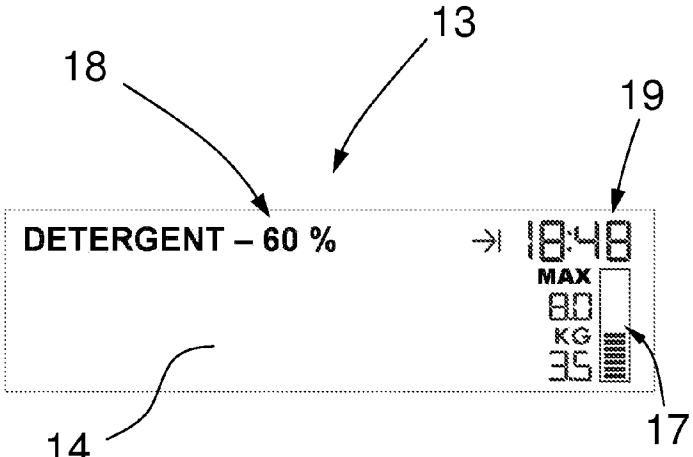
FIG. 7 is an enlarged view of the user interface of the washing machine illustrated in FIG. 3.

The information 18 related to the amount of detergent required for the selected washing programme and for the weight of the laundry 7 loaded into the rotatable drum 6 and detected by the weighing device may be advantageously displayed, as in the example of FIG. 7, in a region of the user interface 13 different from the region of the user interface 13 where the duration of the washing cycle and/or where the weight of the loaded laundry 7 are displayed.

Figure 8:
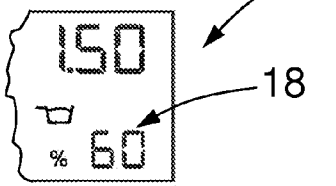
FIG. 8 schematically illustrates a detail of the user interface of a further embodiment of a washing machine according to the invention.

In a further embodiment, schematically illustrated in FIG. 8, the logic unit 12 is configured in such a way that after ending the loading of the laundry 7 into the rotatable drum 6, the information related to the weight of the loaded laundry 7 disappears form the user interface 13, and the information 18 related to the amount of detergent required for the selected washing programme and for the weight of the laundry 7 loaded into the rotatable drum 6 and detected by the weighing device is displayed in the region of the user interface 13 where previously the information regarding weight of the laundry was displayed.

Advantageously, but not necessarily, the logic unit 12 may be configured for calculating and for displaying, after ending the loading of the laundry 7 (and therefore, in the example illustrated in the enclosed Figures, after the closure of the door 4), the approximate hour (indicated by the reference number 19 in FIG. 7) of the day in which a selected washing programme will end (starting substantially in that moment, or according to a preferred delay which may be set by the user) for the weight of the laundry 7 present in that moment into the rotatable drum 6 and detected by the weighing device.

Preferably, but not necessarily, the above indicated approximate hour of the day in which a selected washing programme will end, is displayed in the same region of the display device 14 which is adapted to display the duration of the overall washing cycle.

Preferably, but not necessarily, the logic unit 12 may be configured in such a way that a user is allowed to modify, for example by operating on the user interface 13 and/or on another suitable input device (for example a button or a knob), not illustrated, the duration (or the estimated duration) and/or the number (or the estimated number) of repetitions of one or more of the phases of the washing cycle (for example of the rinsing phase), even after the loading of the laundry 7 (and therefore after the adaptation of the duration—or estimated duration—and/or the number—or estimated number—of repetitions of one or more of the phases of the washing cycle to the weight of the loaded laundry 7 detected by the weighing device); in this case the logic unit 12 may be advantageously configured so as to calculate and to display, via the user interface 13, information related to the duration (or estimated duration) of the washing cycle corresponding to the duration (or estimated duration) and/or number (or estimated number) of repetitions of one or more of the phases of the washing cycle modified by the user after the loading of the laundry 7.

For example, after setting a washing programme and after loading some laundry 7 into the rotatable drum 6, the user interface 13 of the washing machine 1 may display a number (for example the number 1.5 in FIG. 5) representing the duration (or the estimated duration) of the overall washing cycle calculated by the logic unit 12 according to the set washing programme and to the weight of the laundry 7 loaded into the rotatable drum 6 and detected by the weighing device. The logic unit 12 may be configured in such a way that a user, by operating on the user interface 13 and/or on another suitable input device, not illustrated, may modify the duration (or the estimated duration) and/or the number (or the estimated number) of repetitions of one or more of the phases of the washing cycle (for example a user may manually modify the number of rinses which have to be performed during the washing cycle); in this case the logic unit 12 may be configured for calculating the duration (or the estimated duration) of the overall washing cycle corresponding to the modified number of repetitions of rinses, and for representing this new duration (or estimated duration) via the user interface 13. In this case, if this new duration (or estimated duration) doesn't correspond to the user's desired duration (or estimated duration), the user may modify the quantity of laundry loaded into the rotatable drum 6 (for example he may remove some laundry from the rotatable drum 6), and/or the duration (or estimated duration) and/or the number (or estimated number) of repetitions of one or more phases of the washing cycle, until reaching the desired value of the duration (or estimated duration) of the washing cycle.

Preferably, but not necessarily, the logic unit 12 may be configured in such a way to allow a user to set a different washing programme even after starting the loading of the laundry 7 into the rotatable drum 6; in this case the logic unit 12 may be configured for adapting the duration (or the estimated duration) and/or the number (or the estimated number) of repetitions of one or more phases of the washing cycle to the new set washing programme and to the weight of the loaded laundry 7 detected by the weighing device, and for displaying via the user interface 13, information related to the new duration (or estimated duration) and/or number (or estimated number) or repetition of one or more phases of the washing cycle.

In this case if, after setting a first washing programme and starting loading the laundry 7 into the rotatable drum 6, a user wants to change washing programme (for example because he realizes that he set the wrong type of laundry), he may operate on the user interface 13 for changing the washing programme, so that the logic unit 12 modifies the duration (or the estimated duration) and/or the number (or the estimated number) of repetitions of one or more phases of the washing cycle according to the new set washing programme and to the weight of the loaded laundry 7 detected by the weighing device, and displays via the user interface 13 information related to the modified duration (or estimated duration) and/or number (or estimated number) of repetitions.

It is seen therefore how the invention achieves the proposed aim and objects, there being provided a washing machine which, thanks to the possibility, during the loading of the laundry, to provide the user with information related to the duration (or estimated duration) and/or to the number (or estimated number) of repetitions of one or more phases of the washing cycle (and therefore related to the duration—or estimated duration—of the overall washing cycle), allows selecting the right quantity of laundry for obtaining a desired duration (or estimated duration) of the washing cycle in a very easy way; in fact it is sufficient that a user, after setting a washing programme, continues loading the laundry into the rotatable drum until reaching the desired duration (or estimated duration). Moreover, the time required for performing this operation is very small, in particular compared with the above described known solutions.

The invention claimed is:

1. A washing machine comprising:

a washing tub comprising a rotatable drum adapted for receiving the laundry to be washed;

a door which allows access to the washing tub;

a logic unit adapted to control the electric and/or electronic components of said washing machine so as to cause the latter to perform a washing cycle comprising one or more phases;

a user interface adapted for setting a washing programme to which corresponds a washing cycle to be performed, and for presenting user information; and a weighing device adapted to detect the weight of the laundry loaded into the rotatable drum;

said logic unit being operatively connected to said weighing device and to said user interface, and being configured for adapting the duration and/or the number of repetitions of one or more phases of the washing cycle corresponding to a set washing programme to the weight of the loaded laundry detected by the weighing device, and for displaying information related to said adapted duration and/or number of repetitions via said user interface;

wherein, said logic unit is configured for displaying via said user interface when the door is open, during the loading of the laundry into the rotatable drum, information related to the duration and/or the number or repetition of one or more phases of the washing cycle corresponding to a set washing programme and adapted to the weight of the loaded laundry detected by said weighing device.

2. The washing machine according to claim 1, wherein said information related to the duration and/or the number of repetitions of one or more phases of the washing cycle corresponding to a set washing programme and adapted to the weight of the loaded laundry detected by said weighing device comprises the duration of the overall washing cycle.

3. The washing machine according to claim 1, wherein said information related to the duration and/or the number of repetitions of one or more phases of said washing cycle corresponding to a set washing programme and adapted to the weight of the loaded laundry detected by said weighing device comprises the approximate hour of the day at which the end of the washing cycle is foreseen for the set washing programme and the detected weight of the laundry loaded into said rotatable drum.

4. The washing machine according to claim 1, wherein said logic unit is configured for calculating and for displaying, via said user interface, after the setting of a washing programme and before starting the loading of the laundry into the rotatable drum, the duration of the overall washing cycle which corresponds to the set washing programme and which is suitable for a weight of the laundry lower than a prefixed value.

5. The washing machine according to claim 1, wherein said logic unit is configured for calculating and for displaying, via said user interface, after the setting of a washing programme and before starting the loading of the laundry into the rotatable drum, the duration of the overall washing cycle which corresponds to the set washing programme and which is suitable for the maximum weight of laundry which may be introduced into said rotatable drum for said set washing programme.

6. The washing machine according to claim 1, wherein said logic unit is configured in such a way that after the selection of a washing programme and before starting the loading of the laundry into the rotatable drum, said user interface doesn't represent any information related to the duration of the washing cycle which corresponds to the set washing programme.

7. The washing machine according to claim 1, wherein said logic unit is configured in such a way that, after the setting of a washing programme and before starting the loading of the laundry into said rotatable drum, said user interface calculates and displays the duration and/or to the number of repetitions of one or more phases of the washing cycle which correspond to said set washing programme, and which are suitable as long as the weight of the laundry loaded into the rotatable drum remains below a prefixed value, or which are suitable for the maximum weight of laundry which may be introduced into the rotatable drum for said set washing programme.

8. The washing machine according to claim 1, wherein said information related to the number or repetitions of one or more phases of said washing cycle corresponding to a set washing programme and adapted to the weight of the loaded laundry detected by said weighing device comprises the number of rinses to be performed during said washing cycle.

9. The washing machine according to claim 1, wherein said logic unit is configured in such a way as to calculate and to display, via said user interface, the maximum weight of the laundry which may be loaded for a set washing programme.

10. The washing machine according to claim 1, wherein said logic unit is configured in such a way as to calculate and to display, via said user interface when the door is open, during the loading of the laundry, the weight of the loaded laundry and/or the loaded percentage of the maximum allowed weight for the set washing programme.

11. The washing machine according to claim 1, wherein said user interface comprises a level indicator adapted to give a visual indication of the loading level of said rotatable drum.

12. The washing machine according to claim 1, wherein said logic unit is configured in such a way as to calculate and to display, via said user interface, during and/or after the loading of the laundry, information related to the amount of detergent required for the set washing programme and for the detected weight of the laundry loaded into said rotatable drum.

13. The washing machine according claim 12, wherein said logic unit is configured in such a way that said information related to the amount of detergent required for the selected washing programme and for the detected weight of the laundry loaded into said rotatable drum is displayed in a region of the user interface different from the region of the user interface where said information related to the duration and/or of the number or repetition of one or more phases of the washing cycle adapted to the weight of the loaded laundry detected by said weighing device is displayed.

14. The washing machine according to claim 10, wherein said logic unit is configured in such a way that after ending the loading of the laundry into the rotatable drum, said information related to the weight of the loaded laundry disappears from the user interface, and said information related to the amount of detergent required for the selected washing programme and for the weight of the laundry loaded into the rotatable drum is displayed in the same region of said user interface where said information regarding the weight of the laundry was previously displayed.

15. The washing machine according to claim 1, wherein said logic unit is configured in such a way as to allow a user to modify the duration and/or the number of repetitions of one or more of the phases of the washing cycle even after the loading of the laundry into the rotatable drum, and to calculate and to display, via said user interface, the duration of the overall washing cycle corresponding to said modified duration and/or number of repetitions.

16. A washing machine comprising:

a washing tub comprising a rotatable drum adapted for receiving the laundry to be washed;

a door which allows access to the washing tub;

an electric motor for rotating the rotatable drum;

a logic unit adapted to control the electric and/or electronic components of said washing machine so as to cause the latter to perform a washing cycle comprising one or more phases;

a user interface adapted for setting a washing programme to which corresponds a washing cycle to be performed, and for presenting user information;

a weighing device adapted to detect the weight of the laundry loaded into the rotatable drum;

said logic unit being operatively connected to said weighing device and to said user interface, and being configured for displaying information related to the duration and/or number of repetitions of one or more phases of the washing cycle via said user interface, said logic unit being configured for adapting the duration and/or number of repetitions of one or more phases of the washing cycle corresponding to a set washing programme to the actual weight and/or quantity of the loaded laundry calculated/detected, during one or more of the washing phases, as a function of the pressure and/or water level in the washing tub, and/or of the washing liquid absorbed by the loaded laundry, and/or of one or more electrical and/or mechanical quantities related to the rotation of the drum and/or to the electric motor rotating the drum;

wherein:

said logic unit is configured for calculating and for displaying via said user interface when the door is open, during the loading of the laundry into the rotatable drum, information related to the estimated duration and/or number or repetition of one or more phases of the washing cycle corresponding to a set washing programme and adapted to the weight of the loaded laundry detected by said weighing device.

17. The washing machine according to claim 16, wherein said information related to the estimated duration and/or number of repetitions of one or more phases of the washing cycle corresponding to a set washing programme and adapted to the weight of the loaded laundry detected by said weighing device comprises the estimated duration of the overall washing cycle.

18. The washing machine according to claim 16, wherein said information related to the estimated duration and/or number of repetitions of one or more phases of said washing cycle corresponding to a set washing programme and adapted to the weight of the loaded laundry detected by said weighing device comprises the approximate hour of the day at which the end of the washing cycle is foreseen for the set washing programme and the weight of the laundry loaded into said rotatable drum detected by said weighing device.

19. The washing machine according to claim 16, wherein said logic unit is configured for calculating and for displaying, via said user interface, after the setting of a washing programme and before starting the loading of the laundry into the rotatable drum, the duration of the overall washing cycle which corresponds to the set washing programme and which is suitable for a weight of the laundry lower than a prefixed value.

20. The washing machine according to claim 16, wherein said logic unit is configured for calculating and for displaying, via said user interface, after the setting of a washing programme and before starting the loading of the laundry into the rotatable drum, the duration of the overall washing cycle which corresponds to the set washing programme and which is suitable for the maximum weight of laundry which may be introduced into said rotatable drum for said set washing programme.

21. The washing machine according to claim 16, wherein said logic unit is configured in such a way that after the selection of a washing programme and before starting the loading of the laundry into the rotatable drum, said user interface doesn't represent any information related to the duration of the washing cycle which corresponds to the set washing programme.

22. The washing machine according to claim 16, wherein said logic unit is configured in such a way that, after the setting of a washing programme and before starting the loading of the laundry into said rotatable drum, said logic unit calculates and displays, via said user interface, the duration and/or number of repetitions of one or more phases of the washing cycle which correspond to said set washing programme, and which are suitable as long as the weight of the laundry loaded into the rotatable drum remains below a prefixed value, or which are suitable for the maximum weight of laundry which may be introduced into the rotatable drum for said set washing programme.

23. The washing machine according to claim 16, wherein said information related to the estimated number or repetitions of one or more phases of said washing cycle corresponding to a set washing programme and adapted to the weight of the loaded laundry detected by said weighing device comprises the estimated number of rinses to be performed during said washing cycle.

24. The washing machine according to claim 16, wherein said logic unit is configured in such a way as to calculate and to display, via said user interface, the maximum weight of the laundry which may be loaded for a set washing programme.

25. The washing machine according to claim 16, wherein said logic unit is configured in such a way to calculate and to display, via said user interface when the door is open, during the loading of the laundry, the weight of the loaded laundry detected by said weighing device and/or the loaded percentage of the maximum allowed weight for the set washing programme.

26. The washing machine according to claim 16, wherein said user interface comprises a level indicator adapted to give a visual indication of the loading level of said rotatable drum.

27. The washing machine according to claim 16, wherein said logic unit is configured in such a way as to calculate and to display, via said user interface, during and/or after the loading of the laundry, information related to the amount of detergent required for the set washing programme and for the weight of the laundry loaded into said rotatable drum and detected by said weighing device.

28. The washing machine according to claim 27, wherein said logic unit is configured in such a way that said information related to the amount of detergent required for the selected washing programme and for the weight of the laundry loaded into said rotatable drum and detected by said weighing device is displayed in a region of the user interface different from the region of the user interface where said information related to the estimated duration and/or number or repetition of one or more phases of the washing cycle adapted to the weight of the loaded laundry detected by said weighing device is displayed.

29. The washing machine according to claim 27, wherein said logic unit is configured in such a way that after ending the loading of the laundry into the rotatable drum, said information related to the weight of the loaded laundry disappears form the user interface, and said information related to the amount of detergent required for the selected washing programme and for the weight of the laundry loaded into the rotatable drum is displayed in the same region of said user interface where said information regarding the weight of the laundry was previously displayed.

30. The washing machine according to claim 16, wherein said logic unit is configured in such a way to allow a user to modify the estimated duration and/or number of repetitions of one or more of the phases of the washing cycle even after the loading of the laundry into the rotatable drum, and to calculate and to display, via said user interface, the estimated duration of the overall washing cycle corresponding to said modified duration and/or number of repetitions.

* * * * *